US008979721B2

(12) United States Patent
Cavaliere

(10) Patent No.: US 8,979,721 B2
(45) Date of Patent: Mar. 17, 2015

(54) ADJUSTABLE WEIGHT TRAINING DEVICE

(76) Inventor: Jeffrey D. Cavaliere, Norwalk, CT (US)

( * ) Notice: Subject to any disclaimer, the term of this patent is extended or adjusted under 35 U.S.C. 154(b) by 151 days.

(21) Appl. No.: 13/134,403

(22) Filed: Jun. 6, 2011

(65) Prior Publication Data

US 2011/0300999 A1 Dec. 8, 2011

Related U.S. Application Data

(60) Provisional application No. 61/397,228, filed on Jun. 7, 2010.

(51) Int. Cl.

| | |
|---|---|
| ***A63B 71/00*** | (2006.01) |
| ***A63B 21/072*** | (2006.01) |
| ***A63B 23/12*** | (2006.01) |
| ***A63B 21/06*** | (2006.01) |
| ***A63B 21/00*** | (2006.01) |

(52) U.S. Cl.

CPC ..... *A63B 23/1236* (2013.01); *A63B 21/0608* (2013.01); *A63B 21/072* (2013.01); *A63B 21/1469* (2013.01); *A63B 21/1484* (2013.01); *A63B 21/1496* (2013.01)

USPC ..... 482/141; 482/108

(58) Field of Classification Search

CPC ..... A63B 23/1236; A63B 21/0608; A63B 21/072; A63B 21/1469; A63B 21/1484; A63B 21/1496

USPC ..... 482/44–50, 62, 92–93, 95–96, 482/106–108, 131, 133, 139, 141

See application file for complete search history.

(56) References Cited

U.S. PATENT DOCUMENTS

| | | | | |
|---|---|---|---|---|
| D244,628 | S | 6/1977 | Wright | |
| 4,076,236 | A * | 2/1978 | Ionel | 482/108 |
| D274,283 | S | 6/1984 | Wright | |
| 4,566,690 | A * | 1/1986 | Schook | 482/108 |
| 4,768,780 | A * | 9/1988 | Hayes | 482/108 |
| 5,090,693 | A * | 2/1992 | Liang | 482/108 |
| 5,839,997 | A | 11/1998 | Roth et al. | |
| D438,265 | S | 2/2001 | Fenelon | |
| 7,238,147 | B2 * | 7/2007 | Mills et al. | 482/106 |
| D575,361 | S | 8/2008 | Davis | |
| 7,468,025 | B2 | 12/2008 | Hauser et al. | |
| D597,153 | S | 7/2009 | Friedman et al. | |
| 7,588,520 | B2 | 9/2009 | Nalley | |
| 7,614,983 | B1 * | 11/2009 | Krull | 482/107 |
| 2006/0014615 | A1 * | 1/2006 | Godbold | 482/141 |
| 2009/0048079 | A1 | 2/2009 | Nalley | |
| 2009/0156375 | A1 | 6/2009 | Chiang | |
| 2010/0022365 | A1 * | 1/2010 | Ngu | 482/108 |

* cited by examiner

*Primary Examiner* — Loan H Thanh
*Assistant Examiner* — Jennifer M Deichl
(74) *Attorney, Agent, or Firm* — Ware, Fressola, Maguire & Barber LLP

(57) ABSTRACT

An adjustable weight training device includes a core unit which has a substantially flat, rotatable, base with a pair of sides extending away from the base, the sides separated from each other so as to provide for attachment of a handle across the sides, wherein the handle is positioned above the base and dimensioned for gripping by a user's hand. The sides of the core unit include arm cradle regions which are dimensioned for removable receipt of an arm, wherein the arms are dimensioned for removable attachment to the arm cradle regions in the sides of the core unit and extend away from the sides so as to provide for gripping by a user's hand. The arms can be selectively attached to the arm cradle areas and to each other so as to create different configurations of the weight training device.

14 Claims, 4 Drawing Sheets

ADJUSTABLE WEIGHT TRAINING DEVICE

CROSS REFERENCE TO RELATED APPLICATION

This application claims priority under 35 USC §119 to U.S. Provisional Patent Application No. 61/397,228 filed on Jun. 7, 2010.

TECHNICAL FIELD

The present invention is in the technical field of weight/strength training devices. More particularly, the present invention is in the technical field of dumbbell training systems, including an adjustable dumbbell training device/system.

BACKGROUND OF THE INVENTION

Various prior art publications relate to fee weight devices. For example:

- Prior art reveals a weight adjustable dumbbell for performing a push up (US20100022365) Steve Ngu (Jan. 28, 2010);
- Prior art reveals a dual purpose dumbbell (US20090156375) Pang-Ching Chiang (Jun. 18, 2009);
- Prior art reveals a dumbbell weight training device with detachable weight plates (US20090048079) Mark Nalley (Feb. 19, 2009);
- Prior art reveals a dumbbell weight training device with detachable weight plates (U.S. Pat. No. 7,588,520) Mark Nalley (Sep. 15, 2009);
- Prior art reveals a fitness dumbbell with an ornamental design of a circle with a handle through the middle. (USD575,361) Charles P. Davis (Aug. 19, 2008) and (USD274,283) Forrest S. Wright (Jun. 12, 1984);
- Prior art reveals a fitness dumbbell with an ornamental design of an oblong circle with a handle through the middle. (USD244,628) Forrest S. Wright (Jun. 7, 1977);
- Prior art reveals a fitness dumbbell with an ornamental design of a three layered circle with a handle through the middle (USD438,265) Paul J. Fenelon (Feb. 27, 2001);
- Prior art reveals a pushup exercise device that allows the user to perform pushups with the wrists in a neutral position with a rotating handle however it does not provide any significant external weight that would allow the user to perform more than just pushups with the device (D597,153) Mark B. Friedman (Jul. 28, 2009).

As is known in the art, a dumbbell is a conventional weight training device that has long been used by body builders and others to improve their physical strength and appearance as part of a weight training or exercise program. Such a dumbbell typically includes a cylindrical gripping handle that carries a pair of weight plates at opposite ends thereof. In this regard, the weight plates are typically fixedly and connected to the ends of the gripping handle. Should the user wish to increase the weight to be lifted, he/she must find an altogether different dumbbell. In such devices, there is no way for the user to selectively adjust or progressively change the weight of a dumbbell to be used during a workout, such that the gross weight of each dumbbell remains the same at all times.

As a consequence of the foregoing, the fitness center or the user (should the person elect to exercise at their home or office) must maintain many different dumbbells having characteristically different gross weights. Accordingly, the cost to acquire a variety of dumbbells and the space consumed as a result thereof are undesirably increased. Moreover, the user's ability to easily and quickly expand his/her personal weight training program is hampered by the requirement to have ready access to such different dumbbells.

Nevertheless, a number of commercially available adjustable weight dumbbell system are available, such as shown in U.S. Pat. No. 5,839,997 and others. These dumbbell systems are typically mechanically complicated and potentially unstable as they rely on locking mechanisms that can become faulty with progressive use. Therefore, users may experience either confusion which may lead to mistakes when attempting to vary the gross weight of the dumbbell during a workout, or training accidents which can be potentially dangerous.

Likewise a commercially available rotating pushup device is available (e.g., U.S. Pat. No. 7,468,025) that allows the user to perform a pushup exercise while freely rotating the wrists through supination and pronation which allows for increased chest, shoulder, forearm and triceps muscle recruitment without compromising wrist joint integrity. This system however is significantly limited in its strength building applications beyond just this one exercise as it does not allow the user to utilize the device for any other form of overloaded exercise. The muscle overload that is lacking from this device prevents it from being used for any other strength building purpose (as a traditional dumbbell would) than the push up exercise that it is used for. The limitation to the user to just performing pushups with this device will compromise their potential total body strength gains by not allowing them to use the device to train their legs, back, abs, and the aforementioned muscles (chest, shoulders, forearms, triceps) in more direct, diverse and multiple ways.

SUMMARY OF THE INVENTION

Hence, what is desirable is a mechanically simple and easy-to-use dumbbell weight training device having a series of interchangeable weighted arms with correspondingly different weights that are configured to be detachably connected to one another or to the base device in many different combinations so that the gross weight of a single dumbbell may be selectively and progressively varied to conform to the weight training program of the user. Additionally, the asymmetrical loading made possible through the present invention enables off balance loading which can increase muscle fiber recruitment and/or vary the recruitment pattern of muscle fibers in the working muscles so as to produce a stimulus needed for adaptations in strength and muscle growth. Finally, a rotating pushup device that can alternatively or additionally be used as a dumbbell strength training device either from within the position assumed during the pushup exercise or any other body position that can increase the number of exercises and muscle groups targeted by the training tool to make it a much more versatile and complete tool for the user, is needed. The versatility of the present invention allows the user to complete virtually every exercise without needing multiple training devices or dumbbells to accomplish the task.

The present invention provides a different configuration and appearance as compared to a traditional dumbbell, as well as an entirely new device for challenging the muscles worked with traditional dumbbells in a new way due to the change in weight distribution to an "X" shape that the dumbbell training device assumes. Furthermore, the ability to train while holding individual arms of the device creates an additional asymmetrical loading pattern that places an additional productive stress on the muscle being worked (when compared to a traditional dumbbell) and therefore makes it a more functional training device when being used to strengthen muscles for the asymmetrical force loads that they will be subject to during the course of sport activities. Next, the ability of the current invention to rotate freely while performing closed chain exercises (with the dumbbell resting on the ground), provides both the biomechanical comfort to normal wrist mechanics that is not afforded by traditional fixed arm dumbbells, as well as the opportunity to at any point in time revert to traditional technology and assume this fixed position once the device is lifted off the ground. Finally, the current invention provides the user with the opportunity to alter the force load (either symmetrically or asymmetrically) by attaching, detaching, or reattaching, various weighted "arms of the X", classifying this invention in the category of an adjustable dumbbell system as well, without the need for complicated locking mechanisms, pin mechanisms, etc that are susceptible to mechanical breakdown and confusion on behalf of the novice user, since the present invention provides a simple threaded screw attachment for applying and undoing of the arms.

BRIEF DESCRIPTION OF THE DRAWINGS

For a fuller understanding of the nature and objects of the present invention, reference is made to the following figures, in which.

DESCRIPTION OF THE PREFERRED EMBODIMENT

Figure 1:
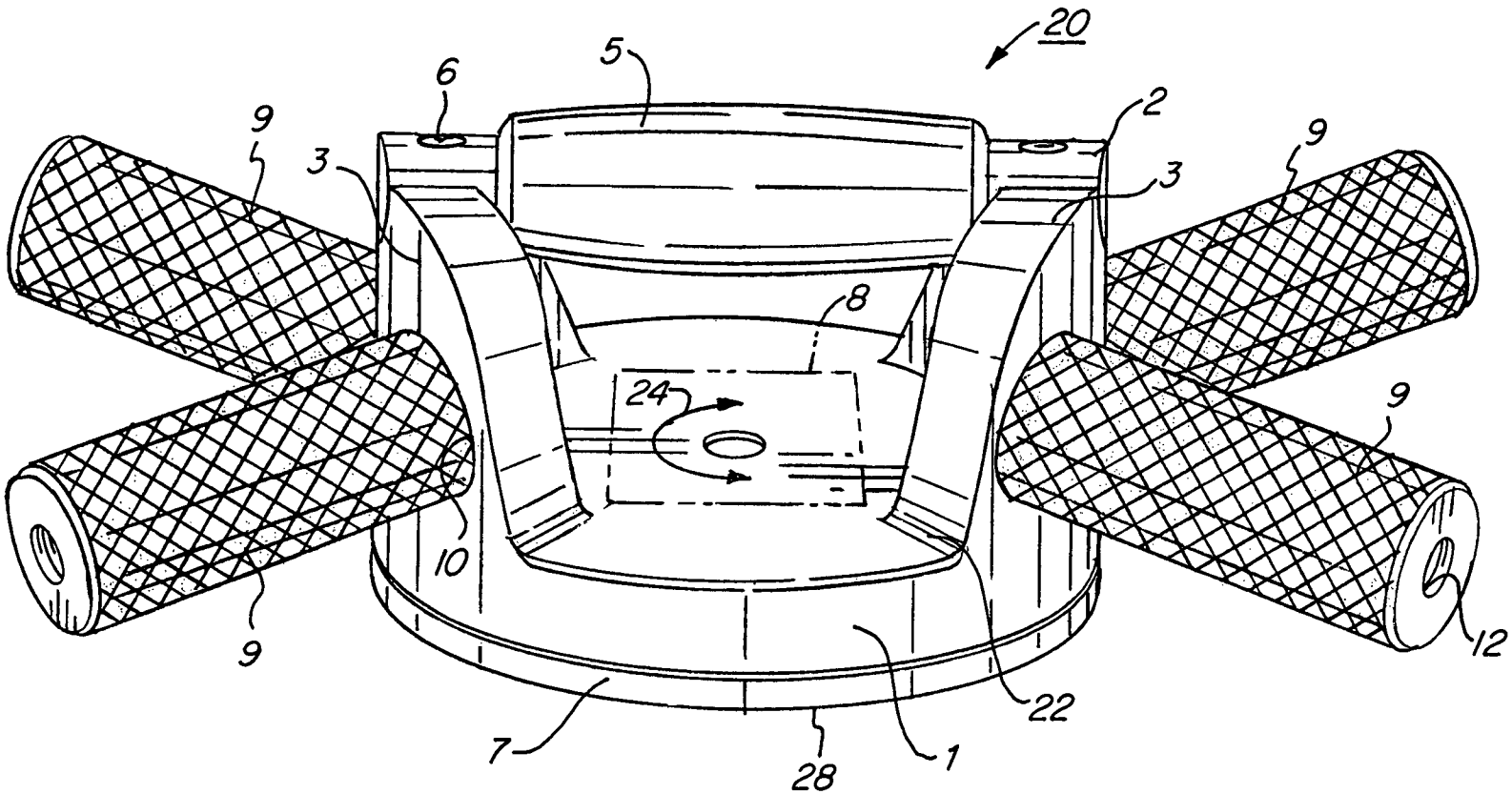
FIG. 1 is a side perspective view of an adjustable weight (dumbbell) training system according to the present invention.
Figure 2:
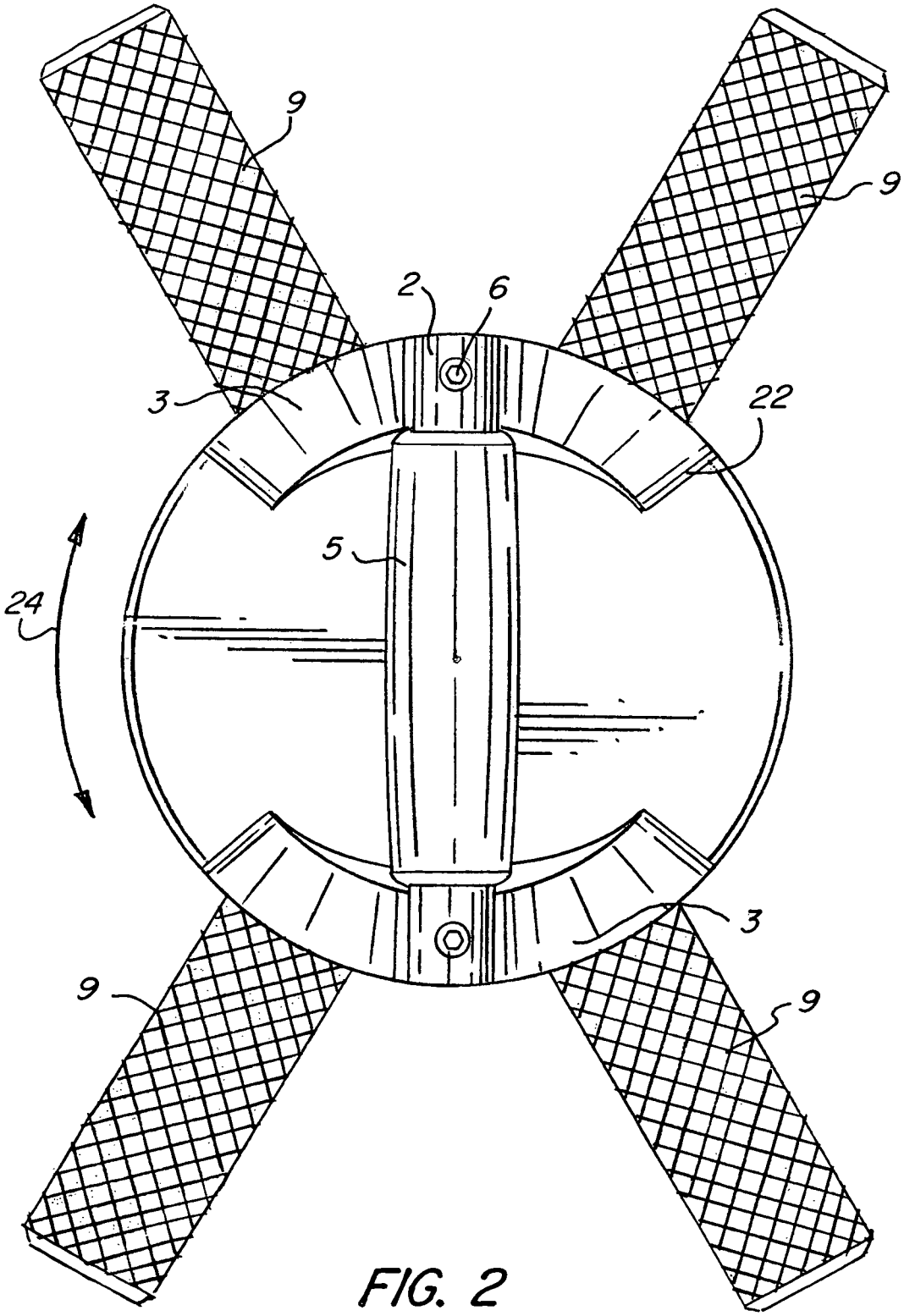
FIG. 2 is a top view of an adjustable weight (dumbbell) training system according to the present invention.
Figure 3:
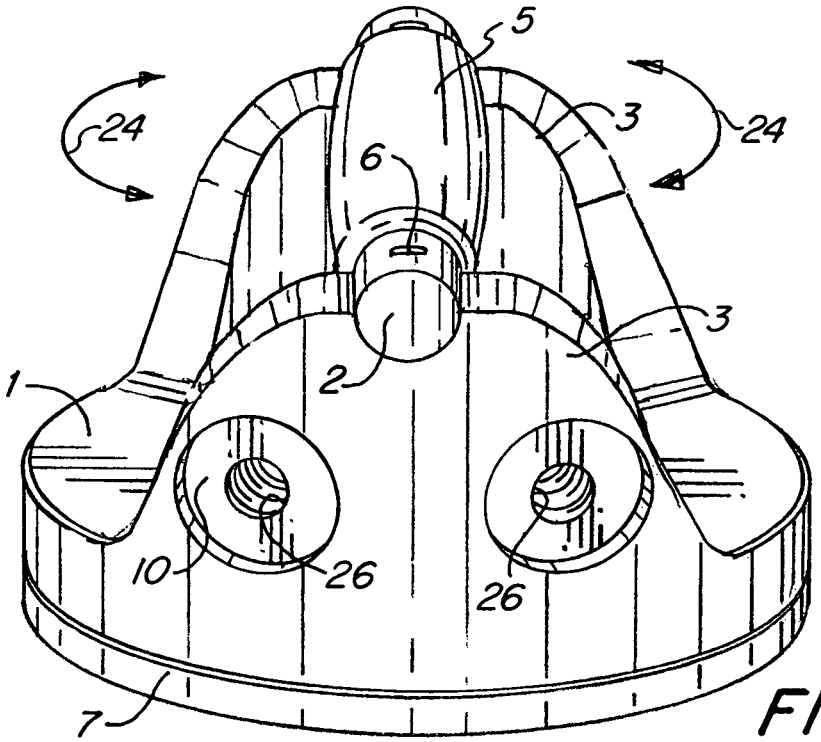
FIG. 3 is a ground side perspective view of a core unit of an adjustable weight (dumbbell) training system according to the present invention with the arms detached from the core unit as shown in FIGS. 3A and 3B.
Figure 3A:
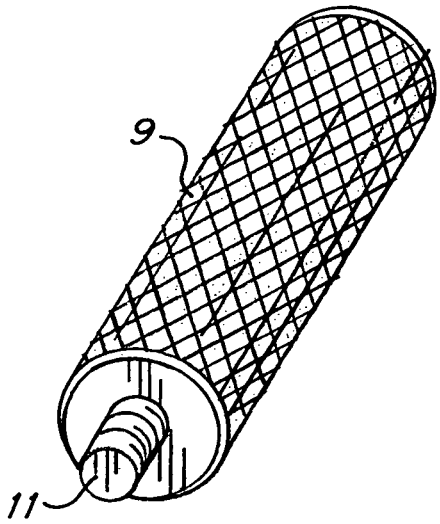
FIG. 3A is a perspective view of an arm of the adjustable weight (dumbbell) training system according to the present invention showing a threaded extension for threaded engagement with threads of a threaded recess in the core unit or in a threaded recess of another arm.
Figure 3B:
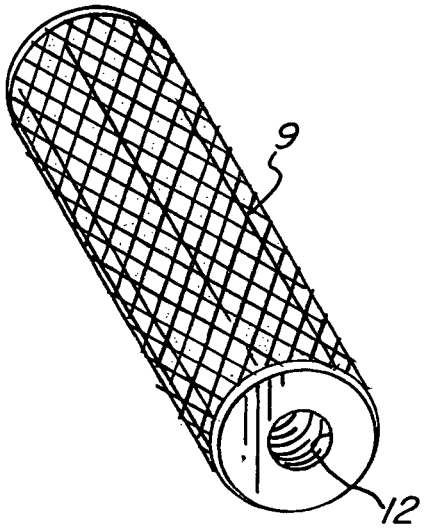
FIG. 3B is a perspective view of an arm of the adjustable weight (dumbbell) training system according to the present invention showing a threaded recess for threaded engagement with the threaded extension of another arm.

As best seen in FIGS. 1-3, an embodiment of an adjustable dumbbell weight training device 20 according to the present invention comprises a core unit 1 having a contoured plate 22 with elevated end points that act as a supporting platform for an attached handle 2. The plate may be fabricated from aluminum. The core unit can be made of steel, cold roll, stainless steel, high strength plastic or polyvinyl chloride (PVC) depending on the desired total weight. The core unit may have a smaller diameter than shown in FIG. 1 if it is desired to have the overall size of the device more compact (such as for a travel-friendly version of the invention). The areas of the plate that elevate, form sides 3 which are located approximately 180 degrees opposite each other and are shaped to have a height so as to create enough of an elevation of the handle to allow for the user to grip the device without having their knuckles uncomfortably in contact with platform 4 (see FIG. 2) of the core unit below it. The handle is typically 1.5" in diameter and 7" in length and is covered by a durable rubber sleeve 5 that is typically 5" in length. The sleeve 5 is used to increase traction of the user's hand on the device to provide support stability and support during use. The handle is held in place by, for example, one hex-wrench compatible screw 6 on each end (see FIG. 2).

As seen in FIG. 1, the core unit may be attached to a base 7 that has a thin platform that can be made of either high strength plastic, PVC, aluminum, steel, stainless steel or cold rolled steel. To make the surface of the device non-slip in nature, the bottom of the base can be covered in a 7.5" diameter piece of rubber or equivalent non-slip material 28 that is affixed thereto, such as with glue, press fit, or adhesive. The base has a 3.25" square lazy susan type ball bearing device 8 (shown in phantom) that is centered on the base and allows for the core unit and its fixed handle to rotate freely in either direction as shown by arrows 24 relative to base 7 when the user applies an appropriate force to either the handle or the arms 9 as described below.

Connected to the core unit at an arm cradle region 10 on the sides 3 of the unit are either zero, one, two, three, or four cylindrical arms 9 that are attached or detached via a simple 0.5" threaded extension 11. A threaded recess 26 is formed in each arm cradle region 10 for mating with a threaded extension 11 of an arm 9. The arms can be 5" in length or longer depending upon the desired total weight of the arm as it relates to altering the weight of the device for a desired training effect. The arms can be made, for example, of steel, cold roll, stainless steel, aluminum, or lead capped depending upon the total desired weight of the device for a desired training effect. The arms can be of thinner diameter to accommodate a smaller hand or thicker to accommodate a larger hand. The arms can assume alternate shapes and do not have to be cylindrical in shape. They can have an octagonal, square, or hexagonal shape, for example. The arms can have a knurled texture across its entire longitudinal periphery to increase the traction and ease of grip for the user. Alternatively, the arms can be covered in a similar rubber sleeve as appears on the handle for the same purpose. The arms are connected at such a height (such as 1.75") to allow the user to assume a prone plank position (standard pushup position) gripping polar opposite arms, one with each hand, and having enough clearance between the floor or exercising surface without making uncomfortable contact between the user's knuckles and said floor or surface. Finally, the arms each can have a 0.5" threaded hole 12 centrally located on one end that allows for other arms or potential future attachments to be connected to each other (via threaded extension 11) to significantly alter the training effect of the device by changing its weight distribution and potential function greatly. One, two, three or four of the arms may be connected to each other in series to create various configurations of the present invention for different strength training purposes or exercises.

The weight training device can be configured in various configurations. The user may then use the present invention in these different combinations (utilizing the arms and the core as described above) to elicit various training effects and to target different muscles. In its primary configuration, as shown in FIGS. 1 and 2, the user can attach each of the four arms 9 to the core unit 1 by screwing in the either four equally weighted arms or four unequally weighted arms. The user can then perform exercises while either gripping the handle with one or two hands (on the floor, seated, standing, reclined, prone, supine, lying on a bench, lying on a physioball, lying on the floor, kneeling, etc.) one arm with two hands, one arm with one hand, any combination of two arms with two hands, or one arm and the handle with two hands. The user may decide to rotate the core upon the base by directing a pronation or supination force through the handle or arms for the desired training effect.

Figure 4:
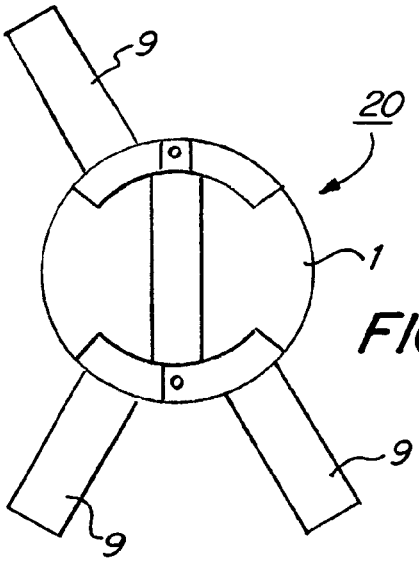
FIGS. 4-6 are diagrammatic views of the adjustable weight training system showing some of the various configurations of the arms with respect to the core unit.

As shown in FIG. 4, the user may use the present invention in an alternative configuration whereby the user can attach three arms to the core unit by screwing in either three equally weighted arms or three unequally weighted arms. The user can then perform exercises while either gripping the handle with one or two hands (on the floor, seated, standing, reclined, prone, supine, lying on a bench, lying on a physioball, lying on the floor, kneeling, etc.) one arm with two hands, one arm with one hand, any combination of two arms with two hands, or one arm and the handle with two hands. The user may decide to rotate the core upon the base by directing a pronation or supination force through the handle or arms for the desired training effect.

Figure 5:
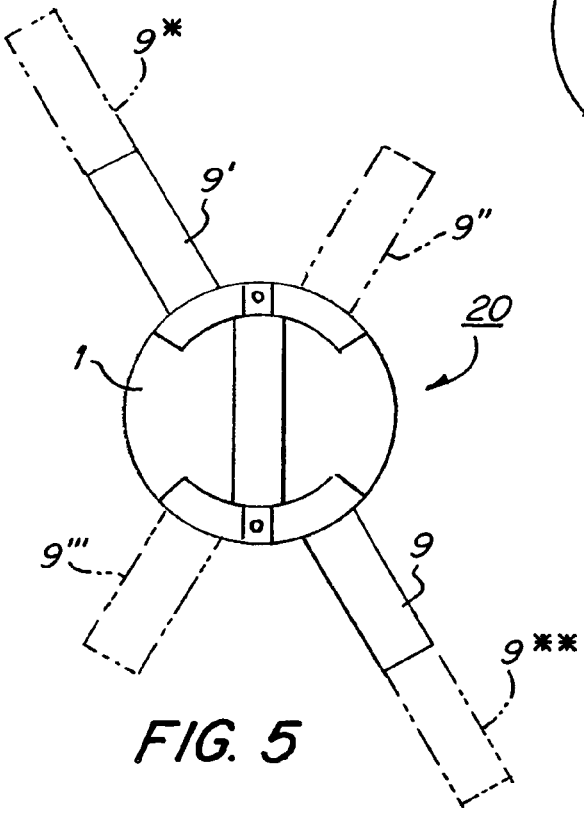

As seen in FIG. 5, the user may also use the present invention in an alternative configuration whereby the user can attach two arms to the core unit by screwing in either two equally weighted arms or two unequally weighted arms. The arms can be connected either adjacent to each other in the 30 degree apart configuration (arms 9' and 9"), adjacent to each other in the 150 degree apart configuration (9' and 9"), or opposite each other in the 180 degree apart configuration (9' and 9). The user can then perform exercises while either gripping the handle with one or two hands (on the floor, seated, standing, reclined, prone, supine, lying on a bench, lying on a physioball, lying on the floor, kneeling, etc.) one arm with two hands, one arm with one hand, two arms with two hands, or one arm and the handle with two hands. The user may decide to rotate the core upon the base by directing a pronation or supination force through the handle or arms for the desired training effect.

Figure 6:
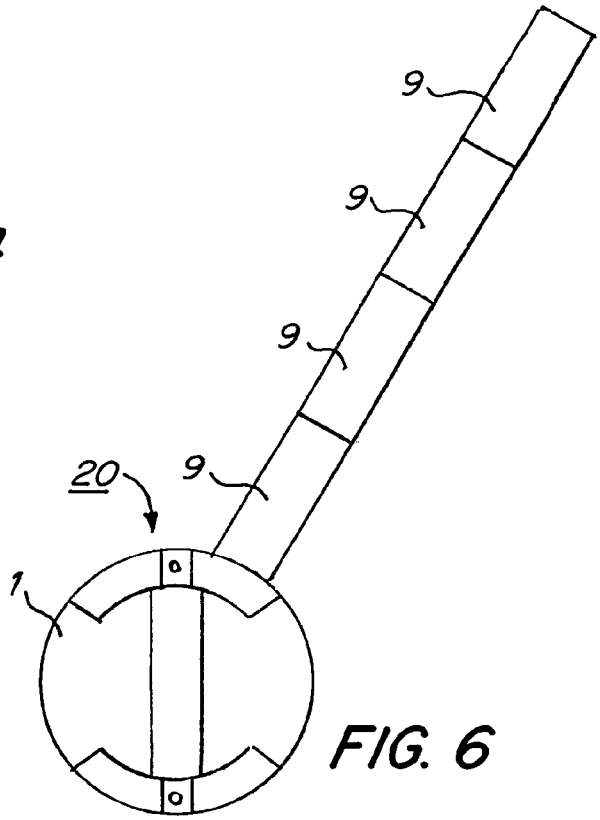

As seen in FIG. 6, the user may use the present invention in an alternative configuration whereby the user can have multiple arms 9 attached to each other (threaded section 11 screwed into threaded recess 12 of the adjacent arm) and secured to one threaded section 26 of core unit 1. The user can then perform exercises while either gripping the handle with one or two hands (on the floor, seated, standing, reclined, prone, supine, lying on a bench, lying on a physioball, lying on the floor, kneeling, etc.) one arm with two hands, one arm with one hand, or one arm and the handle with two hands. The user may decide to rotate the core upon the base by directing a pronation or supination force through the handle for the desired training effect. FIG. 6 shows four arms connected to each other and connected to the core at one threaded recess thereof.

The user may further use the present invention in an alternative configuration whereby the user can use just the core unit 1 (as shown in FIG. 3) without any arm attachments. The user can then perform exercises while gripping the handle with one or two hands (on the floor, seated, standing, reclined, prone, supine, lying on a bench, lying on a physioball, lying on the floor, kneeling, etc.). The user may decide to rotate the core upon the base by directing a pronation or supination force through the handle for the desired training effect.

As shown in FIG. 5, the user may also use the present invention in an alternative configuration whereby the user can attach four total arms (e.g., 9',9*; 9,9**) with two arms attached to the core unit by screwing in either two equally weighted arms or two unequally weighted arms. The arms connected to the core can be either adjacent to each other in the 30 degree apart configuration, adjacent to each other in the 150 degree apart configuration, or opposite each other in the 180 degree apart configuration. The remaining two arms can be attached one each to the ends of each of the already attached arms via the threaded opening at the end of the arm. This will effectively lengthen the total individual arm length to 10" in the present configuration (or shorter/longer depending upon the weight of the arms selected). Alternately, the user can attach all four arms on end to each other and then connect this to the core via one of the threaded openings. The user can then perform exercises while either gripping the handle with one or two hands (on the floor, seated, standing, reclined, prone, supine, lying on a bench, lying on a physioball, lying on the floor, kneeling, etc.) one arm with two hands, one arm with one hand, two arms with two hands, or one arm and the handle with two hands. The user may decide to rotate the core upon the base by directing a pronation or supination force through the handle or arms for the desired training effect.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

What is claimed is:

1. An adjustable weight training device comprising:

a core unit comprising a substantially flat base, a pair of sides extending away from a plane defined by the substantially flat base from the base, the sides separated from each other, and a handle attached across the sides so as to be positioned above the base, the handle generally cylindrical in shape so as to be dimensioned for gripping by a hand; and further wherein each side includes at least two arm cradle regions, each arm cradle region dimensioned for removable attachment of an arm; and a plurality of said arms, each arm having an end dimensioned for removable attachment to one of the arm cradle regions of one of the sides of the core unit, and further including an extending portion that has a multi-sided or cylindrical elongated shape that extends in a direction away from the core unit along a length of the arm, said length of the arm being sufficient for gripping by a hand, said extending portion extending away from the core unit in a direction substantially parallel to the plane defined by the substantially flat base, wherein at least one arm has an area dimensioned for attachment of another arm, and wherein said area formed therein for attachment of another arm is at another end of said arm opposite the end dimensioned for removable attachment to an arm cradle region.

2. The adjustable weight training device according to claim 1, wherein the at least one arm that has an area dimensioned for attachment to another arm is a threaded hole and further wherein the plurality of arms each have a threaded portion which forms the end dimensioned for removable attachment to an arm cradle region of a side, as well as for removable attachment to another arm.

3. The adjustable weight training device according to claim 1, wherein each arm has an outer surface that is knurled.

4. The adjustable weight training device according to claim 1, wherein the handle has a sleeve over a portion thereof, the sleeve dimensioned for secure attachment to the handle and providing a gripping surface for a user's hand.

5. The adjustable weight training device according to claim 1, wherein the end of each arm dimensioned for removable attachment to an arm cradle region of a side is a threaded portion and wherein the arm cradle region includes a threaded recess for receipt of the threaded portion of the arm.

6. The adjustable weight training device according to claim 1, wherein the pair of sides are formed from a contoured plate which is pivotally attached to the base.

7. The adjustable weight training device according to claim 1, wherein the plurality of arms have different weights.

8. The adjustable weight training device according to claim 1, wherein the plurality of arms are cylindrical in shape.

9. The adjustable weight training device according to claim 1, wherein the plurality of arms may have outer peripheries having shapes of one of the following cylindrical, octagonal, hexagonal, and square.

10. The adjustable weight training device according to claim 1, wherein the device further comprises a ball bearing device centered on the base that allows the pair of sides, the handle and the plurality of arms to rotate freely relative to the base.

11. The adjustable weight training device according to claim 10, wherein a bottom of the base includes a non-slip material affixed thereto.

12. The adjustable weight training device according to claim 1, wherein a bottom of the base includes a non-slip material affixed thereto.

13. An adjustable weight training device comprising:

a core unit comprising a substantially flat base, a pair of sides extending away from the base, the sides separated from each other, and a handle attached across the sides so as to be positioned above the base, the handle dimensioned for gripping by a hand; and further wherein each side includes at least two arm cradle regions, each arm cradle region dimensioned for removable attachment of an arm; and a plurality of arms, each arm having an end dimensioned for removable attachment to an arm cradle region of a side, and further including an extending portion dimensioned for gripping by a hand, said extending portion extending away from the core unit in a direction substantially parallel to a plane defined by the substantially flat base, wherein at least one arm has an area dimensioned for attachment of another arm, and wherein said area formed therein for attachment of another arm is at another end of said arm opposite the end dimensioned for removable attachment to an arm cradle region.

14. The adjustable weight training device according to claim 13, wherein the at least one arm that has an area dimensioned for attachment to another arm is a threaded hole and further wherein the plurality of arms each have a threaded portion which forms the end dimensioned for removable attachment to an arm cradle region of a side, as well as for removable attachment to another arm.

* * * * *